United States Patent [19]

Engel

[11] Patent Number: 5,020,182

[45] Date of Patent: Jun. 4, 1991

[54] SINGLE HANDLE APPLICATOR

[76] Inventor: John W. Engel, Rte. 2, Box 177C, Smithville, Tex. 78957

[21] Appl. No.: 496,323

[22] Filed: Mar. 19, 1990

[51] Int. Cl.[5] ..... B05C 1/06; A47K 7/03

[52] U.S. Cl. ..... 15/145; 15/104.94; 15/209 D; 401/268

[58] Field of Search ..... 15/145, 110, 184, 209 D, 15/244 R, 146, 143 R, 104.94; 401/262, 6, 9, 28, 130, 268

[56] References Cited

U.S. PATENT DOCUMENTS

| | | | |
|---|---|---|---|
| 1,616,315 | 2/1927 | French | 15/145 X |
| 2,191,642 | 2/1940 | Carvalho | 15/145 X |
| 2,686,329 | 8/1954 | King | 15/145 X |
| 3,431,575 | 3/1969 | Petersen | 15/145 X |
| 4,299,005 | 11/1981 | Brown | 401/262 |

FOREIGN PATENT DOCUMENTS

| | | | |
|---|---|---|---|
| 50235 | 2/1932 | Norway | 15/145 |
| 2170 | of 1914 | United Kingdom | 15/145 |
| 734716 | 8/1955 | United Kingdom | 15/145 |

*Primary Examiner*—Richard J. Johnson

[57] ABSTRACT

A device having a removable insert such as a brush, massage element or pad for applying lotions, medicines, and the like to human body. The device includes an elongated handle having a receptacle end provided with opposed inwardly facing grooves. The removable inserts are generally rectangular in shape and include integral spring biased tabs at the sides thereof. Each tab is provided with a locking stud that is received in a correspondingly shaped recess in the grooves. Each insert may include a brush, massage element, or disposable pad.

4 Claims, 7 Drawing Sheets

SINGLE HANDLE APPLICATOR

FIELD OF THE INVENTION

This invention relates to the art of applying lotions, medicines, and the like to the human body with a sanitary, clean, and inexpensive pad each time, without the aid of another person, and particularly deals with an injection-moulded plastic handle taking inserts which lock firmly in place for the duration of the application, but which can be easily removed and thrown away, so that a new and sanitary insert may be used for each application.

BACKGROUND OF THE INVENTION

Long handled scrubbers, back brushes, and applicators conventionally have the elongated handle fixed to the brush head, and are made to be used repeatedly. Such devices are unsanitary, an become rapidly unsuitable for the application of lotions, medications, and the like after as few as one application. It would thus be an improvement to the art to provide an applicator consisting of a handle and inexpensive, one-time use inserts which could be disposed of and replaced after each application.

SUMMARY OF THE INVENTION

According to this invention, there is provided a hand operated applicator consisting of a handle made of rigid, injection-moulded plastic, and which has at one end an appropriately shaped handle for the human hand, and which has at the other end an appropriately designed slot with grooves to receive sanitary, disposable, one-time-use inserts, and locking slots to receive the locking studs which are moulded integrally with the plastic bases of the inserts and are on the flexing locking tabs.

This arrangement is designed to allow a person to apply medicines, lotions, and the like to his or her back or other part of the body without the aid of another person, and further, to allow the user to remove the used insert and replace it with a new, inexpensive, and sanitary insert with each application. The mechanical details of the insert end of the handle and of the inserts themselves, are such that wear is minimized to the handle, which is the more permanent and expensive part of the invention.

Another object of this invention is to provide the owner with the option of using the handle (with appropriately fashioned inserts) for functions other than it's primary function, that of sanitary application, without having to purchase other appliances specifically designed for that use (i.e. scrubbing, scratching, etc.). All appliances for use with the handle are to have a common semi-rigid plastic base to which are affixed the appropriate material for that particular function.

ON THE DRAWINGS

AS SHOWN ON THE DRAWINGS

Figure 1:
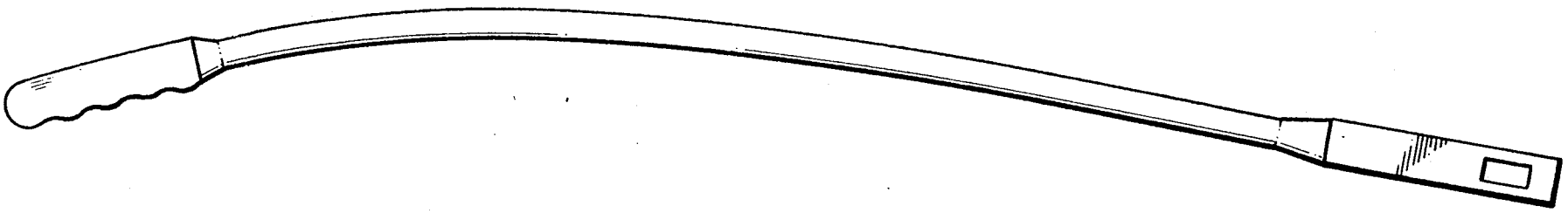
FIG. 1 is a horizontal view of the grasping handle of the apparatus, less the insert receptacle head, which is molded integrally with the handle, at the end opposite the grip.
Figure 2C:
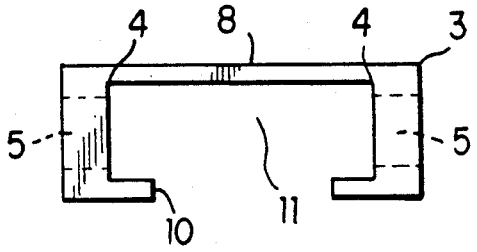
FIG. 2 is a pictoral description of the receptacle end of the applicator.
Figure 2A:
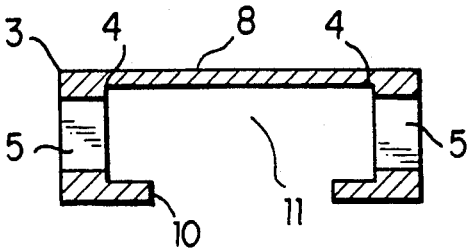
Figure 2B:
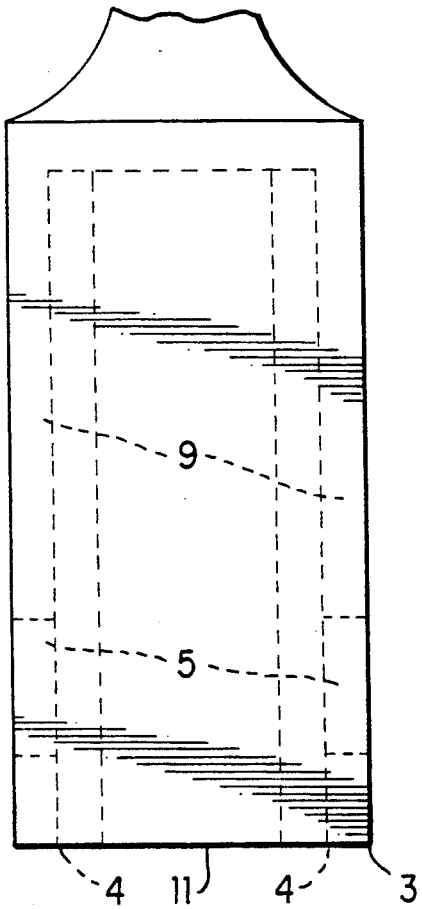
Figure 2D:
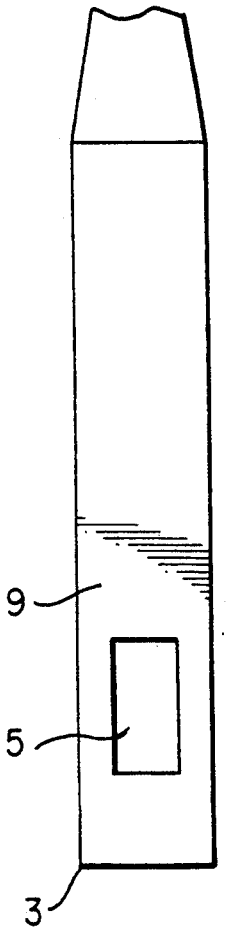

The handle of this invention 1 (FIG. 1) has a grip of textured plastic on one end 2, and a receptacle end 3 (FIG. 1, detail: FIG. 2) with grooves 4 and locking recesses 5 on the other, into which the sanitary disposable inserts (FIG. 3, FIG. 5) and other appliances (FIG. 4, FIG. 6) may be fitted and retained. These inserts are retained by the expendient of the locking studs 6 on the locking tabs 7 both of which are moulded integrally with the plastic base 12 of the inserts.

The receptacle end 3 of the handle 1, is moulded with a solid top 8 and sides 9, and with the bottom of open construction 10, so that the sanitary disposable pads or other appliances may protrude from the opening. The locking recesses 5 are moulded integrally into the sides. The end into which the inserts are placed is left open 11 (FIG. 2).

Figure 7A:
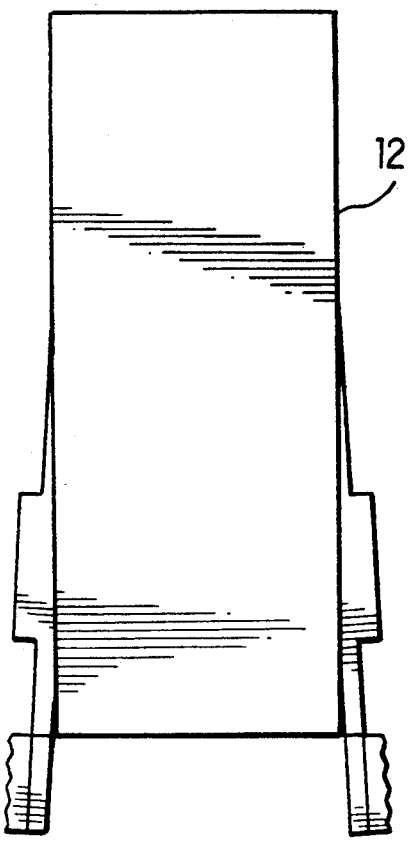
FIG. 7 is a pictoral description of the universal insert plastic base.
Figure 7B:
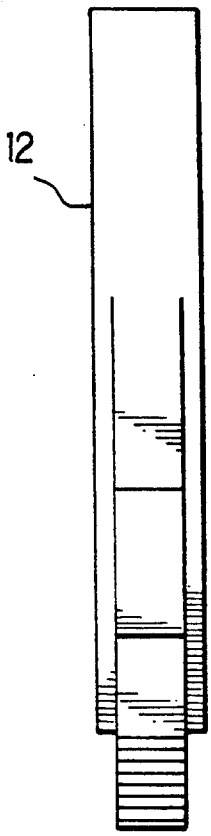
Figure 7C:
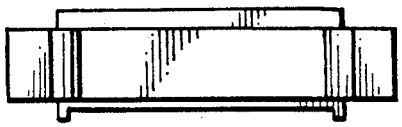

The plastic base 12 to which the sanitary disposable applicator pads and other appliances are affixed is universal to all appliances, consisting of a one piece injection-moulded platform FIG. 7, the dimensions of which allow it to slide snugly into the open end of the receptacle-handle 11, with squeezable locking tabs 7 moulded integrally with the base; these tabs are to be angled at approximately 3 degrees to facilitate the locking of the insert into the receptacle-handle by means of the locking studs 6 on the inserts engaging the locking recesses 5 in the receptacle end of the handle 3, and being forcibly retained therein by the outward spring action of the plastic locking tabs 7.

Figure 3A:
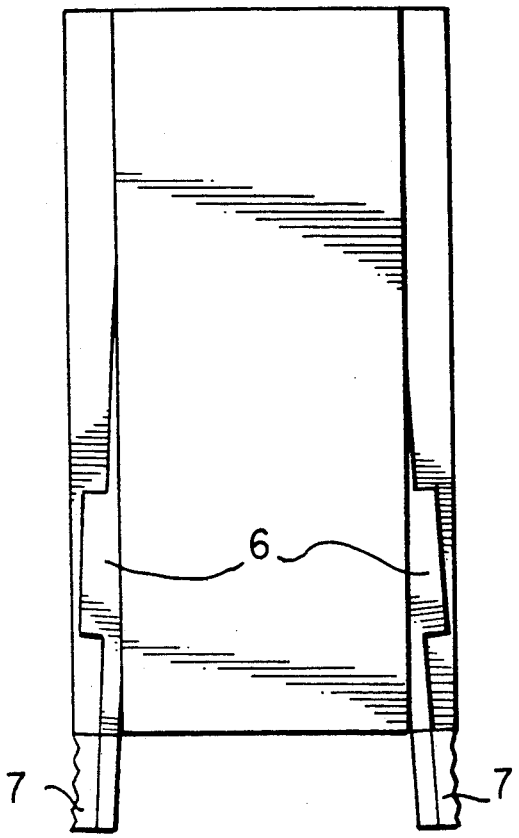
FIG. 3 is a pictoral description of a large size applicator insert.
Figure 3B:
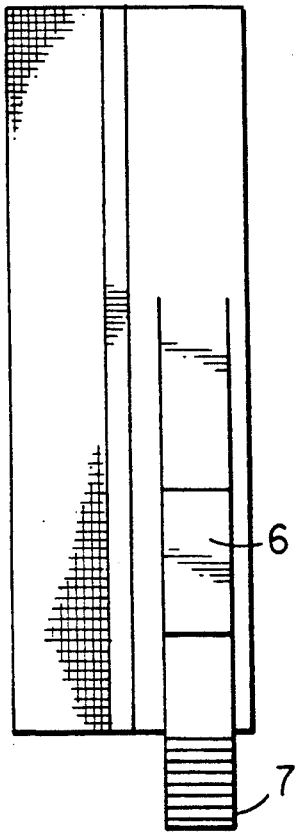
Figure 3C:
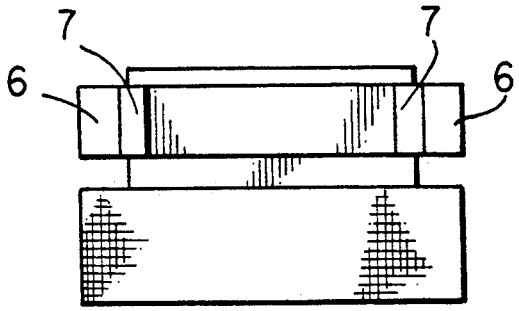
Figure 4A:
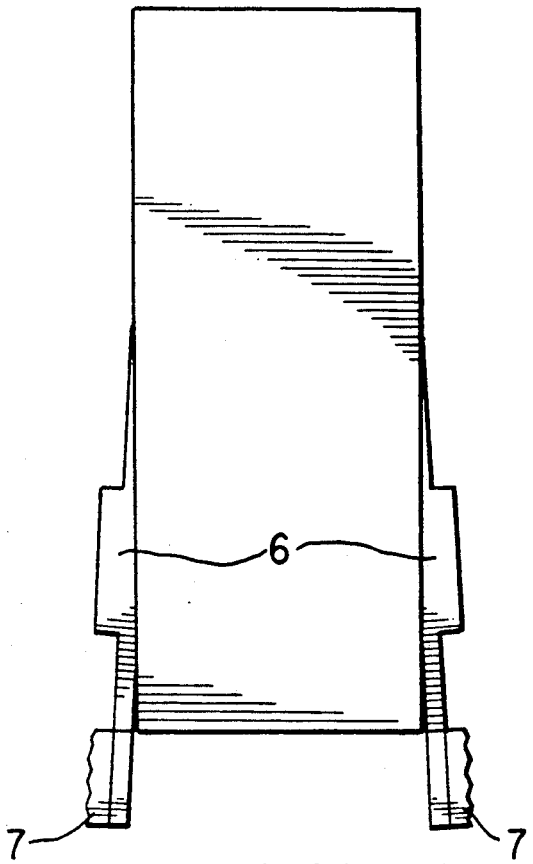
FIG. 4 is a pictoral description of a massage insert.
Figure 4B:
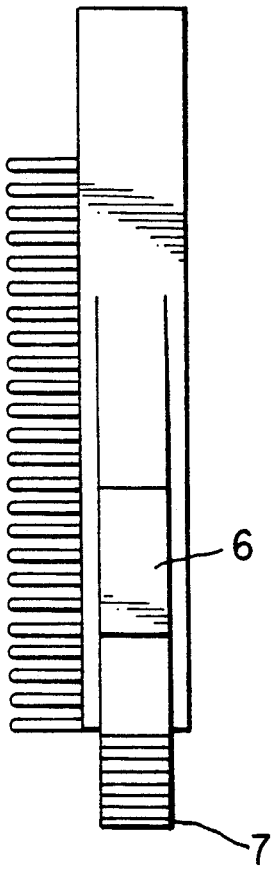
Figure 4C:
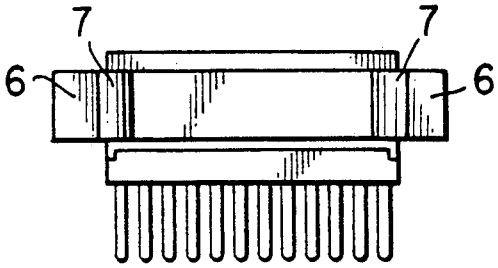
Figure 5A:
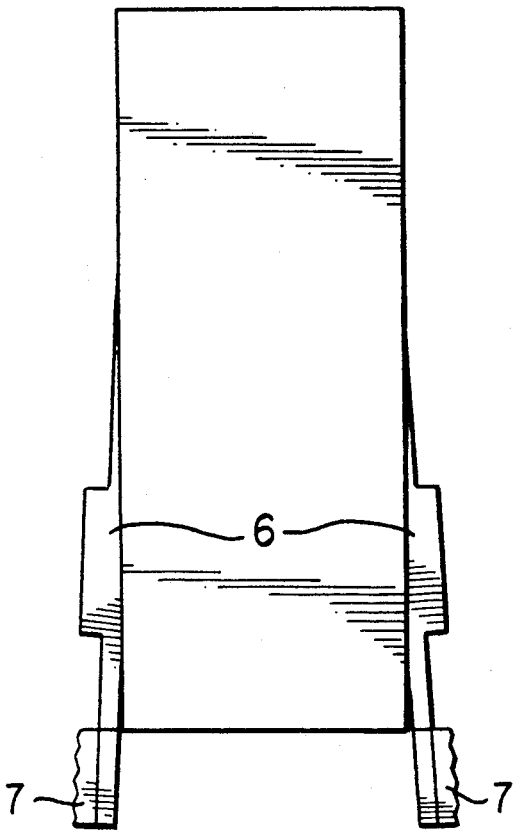
FIG. 5 is a pictoral description of a small size applicator insert.
Figure 5B:
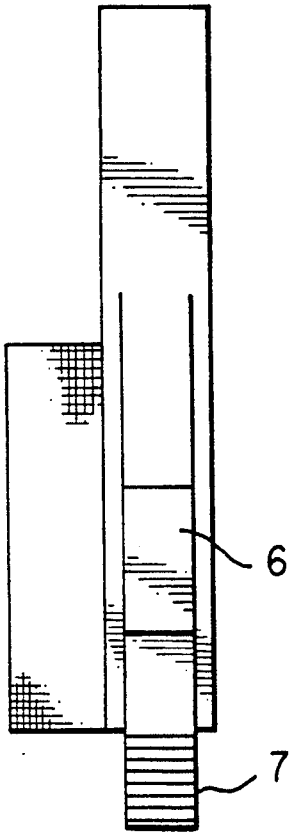
Figure 5C:
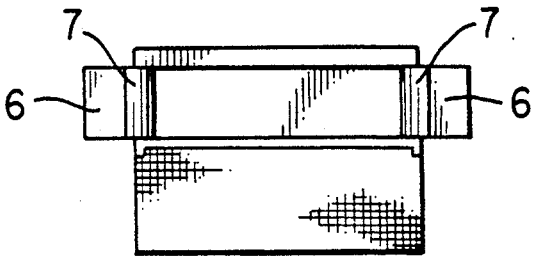
Figure 6A:
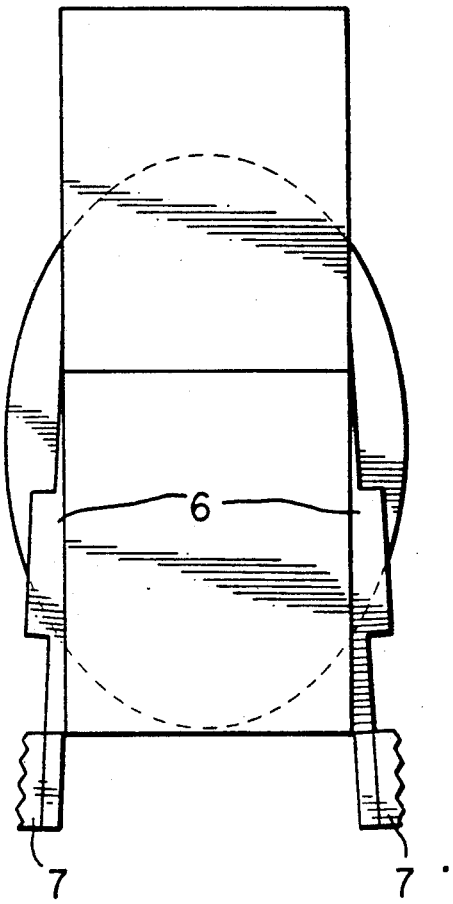
FIG. 6 is a pictoral description of a shower brush insert.
Figure 6B:
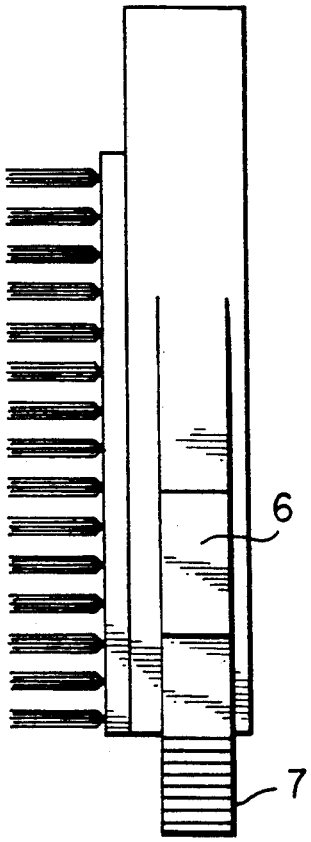
Figure 6C:
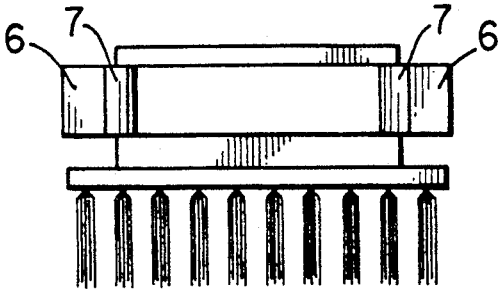

The sanitary and disposable pads, FIG. 3, FIG. 5, as well as any other appliances used with the receptacle-handle portion of this invention are to be bonded with the universal plastic base with adhesive or the like.

In order to insert the disposable sanitary inserts, the user grasps the handle in one hand, and the insert in the other. Aligning the insert with the grooves in the receptacle end of the handle, the user then pushes the insert firmly in place until the locking tabs 7 spring outward, and the locking studs 6 snaps outward into the locking recesses 5.

In order to remove the disposable sanitary inserts, the user grasps the handle in one hand, and the locking tabs 7, of the universal plastic base with the index finger and thumb of the opposite hand and squeezes the locking tabs 7 inward until the locking studs 6 are clear of the locking recesses 5, and then pulls the disposable insert free of the handle. From the above description, it will be readily understood that this invention provides a hand manipulated applicator with which the user can readily and easily use and replace sanitary, one-time-use absorbant pads to apply medicines, lotions, or other substances to the back, or other part of the body without the assistance of another person.

I claim as my invention:

1. An applicator device adapted to be hand held by a user to selectively treat the skin of a user, said device comprising an elongated handle integrally formed with a receptacle end, said receptacle end comprising a pair of opposed inwardly facing grooves along the lateral sides thereof, each of said grooves including a locking recess in the sidewalls thereof, a disposable insert having a generally flat rectangular base portion adapted to be slidably received in said grooves, said base portion including an integral tap portion mounted along the lateral sides thereof and extending outwardly beyond the ends thereof and adapted to be squeezably engaged by the fingers of a user, each tab including a laterally outwardly biased locking stud adapted to be snugly received in a respective locking means rescess and to be released therefrom by a user squeezing said tabs, said disposable insert being provided with a selected body treating means.

2. The applicator of claim 1, wherein the body treating means comprises a massage element.

3. The applicator of claim 1, wherein the body treating means comprises a shower brush.

4. The applicator of claim 1, wherein the body treating means comprises an absorbant pad.

* * * * *